United States Patent [19]

Fowles et al.

[11] 4,091,949

[45] May 30, 1978

[54] ANTIBACKOFF THREADED RING CLOSURE USING RATCHET MEANS

[75] Inventors: Thomas A. Fowles, McHenry, Ill.; David A. Winchell, Twin Lakes, Wis.

[73] Assignee: Baxter Travenol Laboratories, Inc., Deerfield, Ill.

[21] Appl. No.: 777,751

[22] Filed: Mar. 14, 1977

[51] Int. Cl.[2] ..... B65D 41/62

[52] U.S. Cl. ..... 215/251; 215/232; 215/253

[58] Field of Search ..... 215/232, 250, 251, 252, 215/253

[56] References Cited

U.S. PATENT DOCUMENTS

| | | | |
|---|---|---|---|
| 2,950,832 | 8/1960 | Brune | 215/252 |
| 3,871,545 | 3/1975 | Bereziat | 215/251 |
| 3,923,179 | 12/1975 | Choksi | 215/251 |
| 3,923,182 | 12/1975 | Choksi | 215/250 |
| 3,923,183 | 12/1975 | Choksi | 215/251 |
| 3,923,184 | 12/1975 | Choksi | 215/251 |
| 3,923,185 | 12/1975 | Choksi | 215/251 |
| 3,945,525 | 3/1976 | Jones | 215/253 |

*Primary Examiner*—Ro E. Hart

*Attorney, Agent, or Firm*—Paul C. Flattery; John P. Kirby, Jr.; Gary W. McFarron

[57] ABSTRACT

A ratchet mechanism is provided for preventing disassembly of an outer ring used to jack a hermetically sealed overcap from the neck of a container. The ratchet mechanism comprises a set of teeth on the outer ring which act in cooperation with a set of teeth on the overcap thereby providing a means for preventing rotation of the outer ring in a direction tending to unscrew the outer ring from the overcap, but permitting rotation of the outer ring in the jacking direction.

9 Claims, 5 Drawing Figures

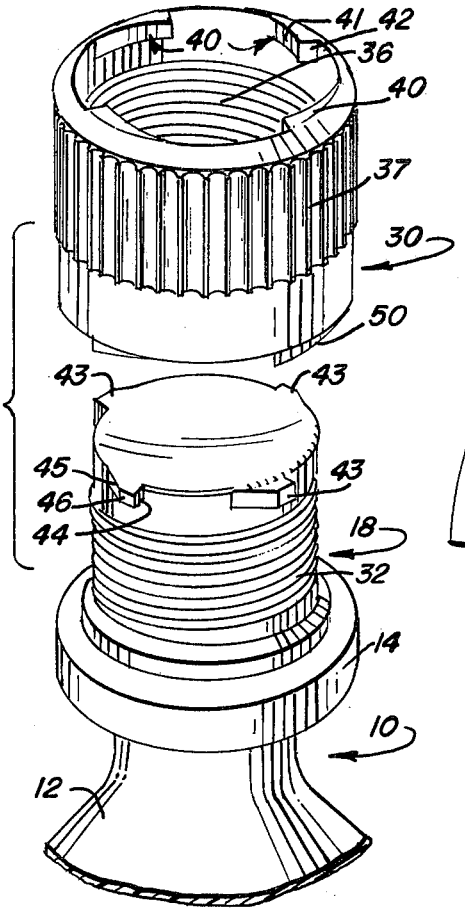
FIG. 1
FIG. 3
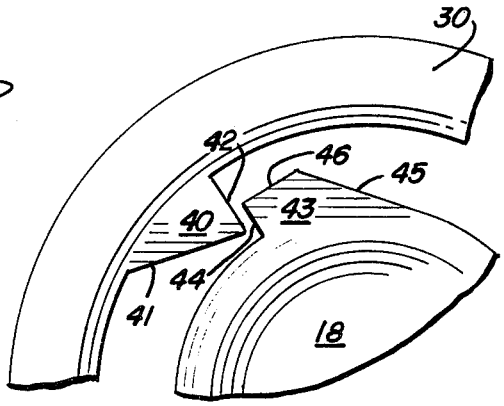
FIG. 4
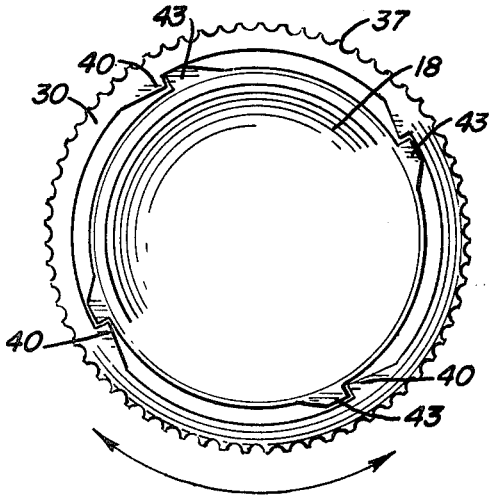
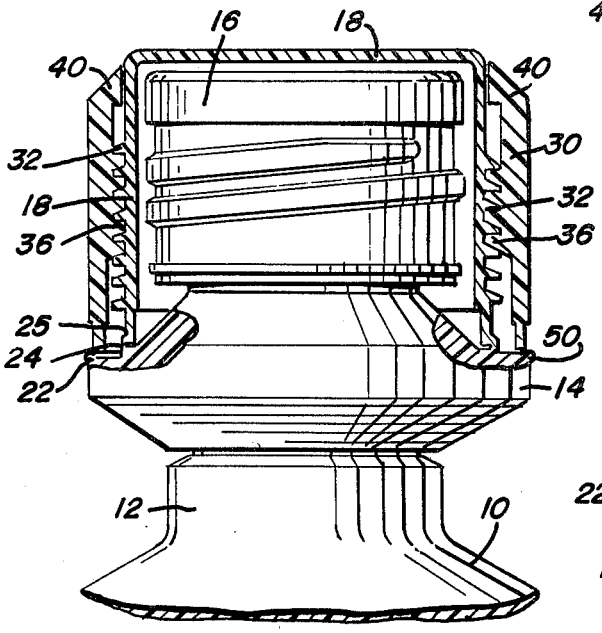
FIG. 2
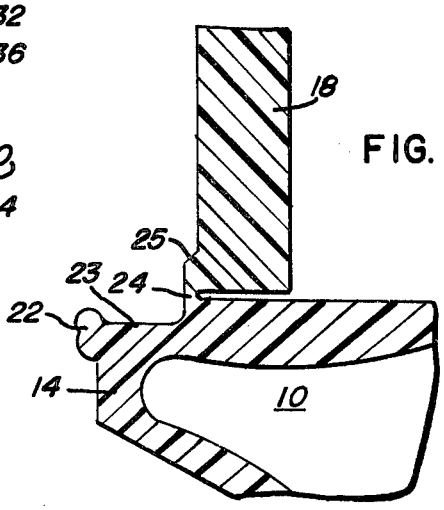
FIG. 5

ANTIBACKOFF THREADED RING CLOSURE USING RATCHET MEANS

BACKGROUND OF THE INVENTION

Containers for storing and dispensing sterile liquids are known which have an outer or overcap on the bottle neck. Such containers are in common use for various medical and hospital procedures, such as the administration or irrigating solutions.

Such sterile liquid medical containers have a common purpose of maintaining the sterility of their liquid contents during storage, shipping and dispensing. It is necessary that the closure system be easy for the nurse or physician to open, preferably by a customary continuous counterclockwise rotation of the closure on the container.

One prior art closure for a container having a neck defining a dispensing outlet is disclosed in Choksi U.S. Pat. No. 3,923,182. The closure includes an overcap fitted on the bottle neck closing the dispensing outlet and connected to the bottle neck to define a hermetic seal. The overcap is threaded on its outer surface. An outer ring fits over the overcap and has internal threads engaged with the threads on the overcap. Downward rotation of the outer ring with respect to the overcap serves to jack the overcap off the bottle neck, breaking the hermetic seal.

Difficulty has been experienced when the nurse or physician turns the outer ring in the wrong direction removing the outer ring from the overcap without severing the hermetic seal and without removing the overcap. In addition, the outer ring may become disassembled from the overcap during handling or shipment.

In the normal assembly operation of the overcap to a bottle neck, the overcap is heat fused to the bottle neck to form the hermetic seal. It is necessary that the overcap be accessible to the heat and pressure die during assembly. Thus difficulty would be experienced if the outer ring were assembled to the overcap prior to sealing the container. The outer ring is commonly assembled after installation of the overcap on the container.

It is an object of the present invention to provide a container closure system having an outer jacking ring which cannot become unscrewed inadvertently.

A still further object of the invention is to provide a container system in which the person desiring to remove the closure is prevented from unscrewing a portion of the closure in the wrong direction.

Another object of the present invention is to provide a closure system for a container which has an antibackoff feature, is simple in construction and is relatively easy to assemble.

Other objects and advantages of the present invention will become apparent as the description proceeds.

SUMMARY OF THE INVENTION

In accordance with the present invention, there is provided a hermetically sealed container for storing and dispensing sterile liquids. The container is of a type including a bottle with a neck which comprises a dispensing outlet, with the bottle having a transverse abutment means on the neck surrounding the outlet.

An overcap is provided having a cylindrical sidewall and a top wall fitted on the bottle neck enclosing the dispensing outlet. The overcap is hermetically sealed to the bottle neck. An outer ring is threadedly interfitted over the overcap and is adapted for rotation in the downward direction to exert a downward force against the abutment means to jack the overcap off the bottle neck. A ratchet mechanism is provided, having teeth on both the overcap and the outer ring so as to prevent rotation of the outer ring in a direction which would cause the outer ring to move away from the bottle neck.

In one embodiment, the ratchet mechanism comprises teeth having an inclined side and a generally flat side. The teeth on the overcap and the outer ring are arranged such that (a) with rotation of the outer ring in the downward direction, the inclined sides of the teeth pass over each other permitting the rotation, and (b) with rotation of the outer ring in the opposite direction the flat sides of the teeth abut thereby preventing further rotation of the outer ring in the opposite direction.

A more detailed explanation of the invention is provided in the following description and claims and is illustrated in the accompanying drawings.

BRIEF DESCRIPTION OF THE DRAWINGS

FIG. 1 is a perspective view of an improved closure constructed in accordance with the principles of the present invention, showing the outer ring in position to be screwed onto the overcap;

FIG. 2 is a cross-sectional elevation thereof, with the outer ring being in position;

FIG. 3 is an enlarged top plan detail view illustrating a pair of ratchet teeth;

FIG. 4 is a top view of the closure of FIG. 2; and

FIG. 5 is an enlarged cross-sectional view illustrating the heat and pressure seal of the overcap providing a frangible section.

DESCRIPTION OF THE PREFERRED EMBODIMENT

Referring now to the drawings, there is fragmentarily illustrated a thermoplastic container 10 including a thermoplastic bottle 12 and bottle neck 14. Container 10 has a dispensing outlet extending through bottle neck 14. Container 10 contains sterile medical liquids, such as normal saline, sterile water or other commonly supplied hospital liquids. A primary cap 16 is used to seal the dispensing outlet. The primary cap 16 may be of a known type, which is threadedly connected to the bottle neck, or it may be heat sealed to the bottle.

An overcap 18 is provided to enclose primary cap 16 and to form a hermetically sealed enclosure over primary cap 16. To this end, overcap 18 is fused to bottle neck 14.

Overcap 18 is formed of thermoplastic material of an inverted cup-shape initially having an annular radially outwardly extending flange positioned on bottle neck 14. The flange of the overcap has been removed from the overcap and forced into an annular bead 22 as a result of downward heat and pressure, which also forms a depression 23 around the top surface of neck 14. A frangible section 24 is thus formed normal to depression 23 with frangible section 24 forming the vertical sidewall of depression 23. A chamfer 25 is provided adjacent frangible section 24. Frangible section 24 forms a hermetic seal between the overcap 19 and container 10.

An outer ring 30 is positioned over overcap 18 and is provided with complementary internal threads 36 operatively associated with the external threads 32 on overcap 18. Outer ring 30 has a knurled portion 37 to aid in grasping and turning. The threads are preferably left-hand threads so that counterclockwise rotation of the outer ring will move the outer ring downwardly with respect to the overcap. The outer ring is assembled so that its bottom edge is adjacent the top surface (abutment surface) 23 of neck 14. When turned in the counterclockwise direction, the outer ring will abut surface 23 and jack the overcap upwardly away to break the frangible section 24 in tension.

When the closure is assembled in the manner shown in FIG. 2, the outer ring cannot be removed from the overcap by upward rotation of the outer ring. To this end, ratchet teeth 40 and 43 provide an interference mechanism for preventing upward rotation.

Outer ring teeth 40 include a flat side 42 normal to the inside cylindrical sidewall of the outer ring and inclined side 41 having an increasing slope ramp, one end ending at the junction of flat side 42 and the other at the junction with the inside cylindrical sidewall of outer ring 30. Overcap teeth 43 extend outward from the outside cylindrical sidewall of overcap 18. Overcap teeth 43 include an inclined side 45, a flat side 44 which is normal to the outside cylindrical sidewall of the overcap, and a truncated surface 46. Outer ring teeth 40 may slide over surfaces 45 and 46 during rotation in the proper direction.

The distance between the outside cylindrical sidewall of the overcap 18 and the inside cylindrical sidewall of the outer ring 30 as measured in the plane in which the respective teeth of each lie is such that, as illustrated in FIG. 3, the teeth 40, 43 must overlap. The proper direction of rotation of the outer ring 35 as viewed in FIG. 3 is counterclockwise with respect to overcap 19. Proper rotation of the outer ring will cause the inclined side 41 of outer ring teeth 40 to come into contact with the inclined side 45 of overcap teeth 43. Continuing rotation in the proper direction, each tooth 40 will begin to travel upward along the sloping side 45 of a tooth 43, which is allowed by the outward deformation of the outer ring. Slight deformation of the overcap 18 may also occur. The deformation continues until the tip of tooth 40 reaches the flat surface 46 of tooth 43. As tooth 40 slides past the flat surface 46 of tooth 43, tooth 40 snaps back into its normal position as the outer ring returns to its original shape. Thereby rotation of the outer ring in the proper counterclockwise direction is permitted.

Clockwise rotation or rotation in the wrong direction will cause the flat surface 42 of each tooth 40 to abut the flat side 44 of a tooth 43 thereby causing an interference to the rotation of the outer ring. Therefore, once the outer ring is in the position of abutting the abutment means 23 on the bottle neck thereby aligning the outer ring teeth and the overcap teeth in the same plane, the ratchet mechanism is completed captivating the outer ring.

In assembling the outer ring 30 over the overcap 18, the outer ring is screwed downward over the overcap until the bottom edge 50 of the outer ring rests upon depressed surface 23 of bottle neck 14. As the outer ring is screwed onto the overcap, the outer ring deforms slightly enabling the inclined teeth on the outer ring to slide over the inclined teeth on the overcap.

With the bottom edge 50 of the outer ring resting on the bottle neck, both sets of ratchet teeth 40, 43 lie in the same plane. Thus, rotation of the outer ring 30 in the downward direction with respect to the overcap 18 is not inhibited by the ratchet mechanism, because the teeth are inclined to allow the teeth 40 of the outer ring 30 to pass over the teeth 43 of the overcap 18. However, rotation in the wrong direction is inhibited because the flat sides 42, 44 of the ratchet teeth 40, 43, respectively, engage thereby restricting further rotation of the outer ring. In this manner, removal of the outer ring 30 without jacking the overcap 18 upwardly to break the seal is prevented.

Although an illustrative embodiment of the invention has been shown and described, it is to be understood that various modifications and substitutions may be made by those skilled in the art without departing from the novel spirit and scope of the invention.

What is claimed is:

1. A hermetically sealed container for storing and dispensing sterile liquids, which comprises: a bottle with a neck defining a dispensing outlet, said bottle having a transverse abutment means on the neck surrounding the outlet; an overcap having a cylindrical sidewall and a top wall fitted on said bottle neck enclosing said dispensing outlet, said overcap being hermetically sealed to said bottle neck; an outer ring threadedly interfitted over said overcap and adapted for rotation in the downward direction to exert a downward force against said abutment means to jack said overcap off said bottle neck; and a ratchet mechanism having teeth on both said overcap and said outer ring so as to prevent rotation of the outer ring in a direction which would cause the outer ring to move away from the bottle neck.

2. A container as described in claim 1, wherein said overcap and bottle are formed of thermoplastic material and said hermetic seal comprises a heat fused seal between said overcap and said bottle neck.

3. A container as described in claim 1, wherein said outer ring is formed of a thermoplastic material enabling said outer ring to deform as the teeth in the ratchet mechanism slide over one another.

4. A container as described in claim 1, wherein the outer surface of said outer ring is knurled to assist in turning said outer ring.

5. A container as described in claim 1, wherein said ratchet mechanism comprises teeth having an inclined side and a generally flat side, the teeth on said overcap and said outer ring arranged such that (a) with rotation of the outer ring in the downward direction the inclined sides of the teeth pass over each other and (b) with rotation of the outer ring in the opposite direction the flat sides of the teeth abut thereby preventing further rotation of the outer ring in said opposite direction.

6. A hermetically sealed container, which comprises: a bottle with a neck defining a dispensing outlet, said bottle having a transverse abutment means on the neck surrounding the outlet; a cup-shaped overcap having a cylindrical sidewall and a top wall hermetically bonded to the bottle neck, said overcap enclosing an inner primary seal and having teeth projecting outward on the outside cylindrical sidewall near the top of said overcap, each tooth having an inclined side and an abutment side; an outer ring threadedly interfitting over said overcap and adapted for rotation in the downward direction to exert a downward force against said abutment means on the bottle neck and jack said overcap off said bottle neck, said outer ring having teeth projecting inwardly on the inside cylindrical sidewall near the top of the outer ring, each tooth having an inclined side and an abutment side; said teeth positioned such that the teeth on the overcap and the teeth on the outer ring lie in a common plane initially and operate in conjunction with each other to allow rotation of the outer ring in the downward direction by the outer ring teeth sliding over the overcap teeth but preventing rotation in the upward direction of the outer ring by an interference created by the abutment side of the outer ring teeth and the abutment side of the overcap teeth.

7. A container as described in claim 6, wherein said outer ring, overcap and bottle are formed of thermoplastic material.

8. A container as described in claim 6, wherein said outer ring is formed of a thermoplastic material enabling said outer ring to deform as the outer ring teeth and the overcap teeth pass over each other.

9. An improvement as described in claim 6, wherein the outer surface of said outer ring is knurled to assist in turning said outer ring.

* * * * *